United States Patent [19]

Calder

[11] Patent Number: 4,715,537

[45] **Date of Patent: * Dec. 29, 1987**

[54] SPRAY TIP

[75] Inventor: Oliver J. Calder, Orange, Calif.

[73] Assignee: Phyllis Graham, Orange, Calif.

[ * ] Notice: The portion of the term of this patent subsequent to Nov. 20, 2001 has been disclaimed.

[21] Appl. No.: 766,190

[22] Filed: Aug. 16, 1985

Related U.S. Application Data

[63] Continuation-in-part of Ser. No. 662,615, Oct. 19, 1984, abandoned, which is a continuation-in-part of Ser. No. 575,153, Jan. 30, 1984, Pat. No. 4,537,355, which is a continuation of Ser. No. 457,919, Jan. 14, 1983, Pat. No. 4,484,707, which is a continuation-in-part of Ser. No. 442,525, Nov. 18, 1982, Pat. No. 4,483,481, which is a continuation of Ser. No. 165,247, Jul. 2, 1980, abandoned.

[51] Int. Cl.[4] ..... B05B 15/02

[52] U.S. Cl. ..... 239/119; 239/288.3; 239/391; 239/600

[58] Field of Search ..... 239/119, 288, 288.3, 239/390–392, 600, 288.5; 251/172, 174

[56] References Cited

U.S. PATENT DOCUMENTS

| | | | |
|---|---|---|---|
| 3,118,650 | 1/1964 | Cooper et al. | 251/174 |
| 3,202,360 | 8/1965 | O'Brien | 239/119 |
| 4,074,857 | 2/1978 | Calder | 239/288.3 |
| 4,116,386 | 9/1978 | Calder | 239/119 |
| 4,165,836 | 8/1979 | Eull | 239/288 |
| 4,256,260 | 3/1981 | Piggott | 239/600 |
| 4,479,513 | 10/1984 | Koch et al. | 251/172 |
| 4,483,481 | 11/1984 | Calder | 239/119 |
| 4,484,707 | 11/1984 | Calder | 239/119 |
| 4,508,268 | 4/1985 | Geberth, Jr. | 239/119 |
| 4,537,355 | 8/1985 | Calder | 239/119 |
| 4,611,758 | 9/1986 | Geberth, Jr. | 239/119 |

*Primary Examiner*—Andres Kashnikow
*Assistant Examiner*—Michael J. Forman
*Attorney, Agent, or Firm*—Plante Strauss Vanderburgh

[57] ABSTRACT

There is disclosed an improved spray tip for airless spraying of liquids in which the spray orifice is mounted in a rotatable turret member which is captured in a subassembly of a plastic spray guard and a tubular metal housing. The housing has a longitudinal through passageway which receives a floating piston seal member that has a forward, cylindrically concave face which is urged into a tight seal against the rotatable turret member by the liquid pressure which acts on the upstream face of the floating piston seal member. The floating piston seal member is sealed in the longitudinal through passageway by an annular seal which also restrains the turret member against rotation when the liquid pressure is released, thereby freely permitting substitution of spray orifices by interchanging of turret members. The turret member includes a handle with a dependent prong which is received through a slotted aperture of the spray guard into an internal cavity of the spray guard body having one side wall with shoulders which provide abutment stops for the turret member, thereby aligning its transverse bore with the longitudinal passageway through the housing.

14 Claims, 3 Drawing Figures

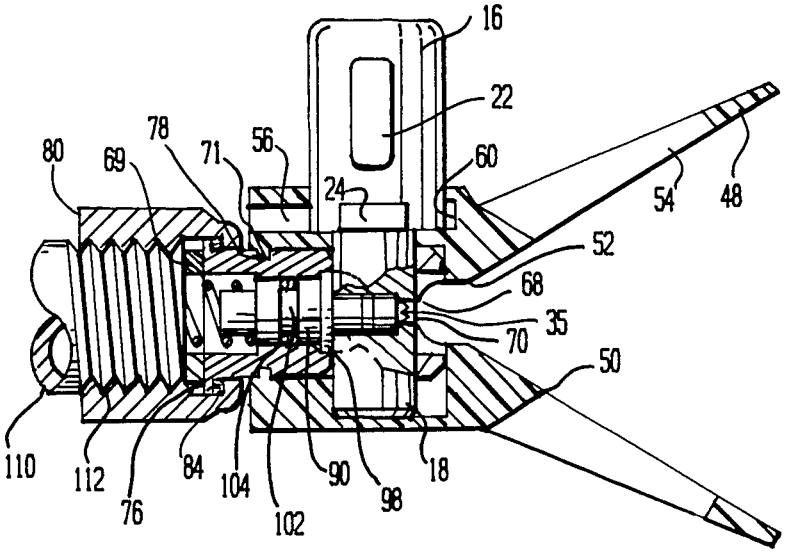
FIGURE 2
FIGURE 3
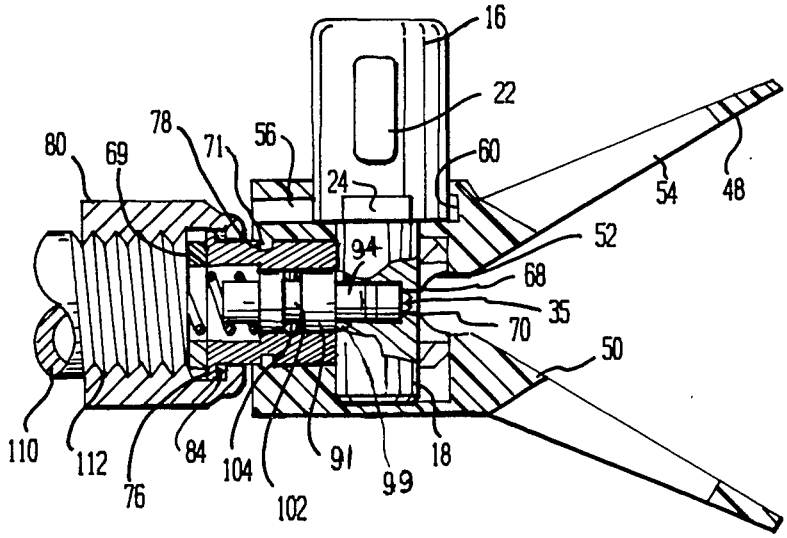

SPRAY TIP

REFERENCE TO RELATED APPLICATIONS

This application is a continuation in part of Ser. No. 662,615, filed Oct. 19, 1984, now abandoned, which is a continuation in part of Ser. No. 575,153 filed Jan. 30, 1984, now U.S. Pat. No. 4,537,355 which is a continuation of Ser. No. 457,919 filed Jan. 14, 1983, now U.S. Pat. No. 4,484,707, which is a continuation in part of Ser. No. 442,525, filed Nov. 18, 1982, now U.S. Pat. No. 4,483,481, which is a continuation of Ser. No. 165,247, filed July 2, 1980, now abandoned.

BACKGROUND OF THE INVENTION

1. Field of the Invention

This invention relates to a spray tip for airless spraying, and, in particular, to such a spray tip provided with a reversible and interchangeable turret member.

2. Brief Statement of the Prior Art

In my prior U.S. Pat. No. 3,831,862, I disclosed a spray tip assembly in which the spray tip orifice is mounted in a removable and reversible sleeve which is secured in the housing with a sliding pin interlock that seats against a spring biased seal. This construction requires loosening of the body from its adapter to reverse and/or replace the spray tip orifice.

In my prior U.S. Pat. No. 4,116,386, I disclosed a spray tip assembly in which the spray tip orifice is mounted in a cylindrical turret member which can be rotated in the housing to reverse the orifice member for cleaning. This construction employs a solid, resilient plastic seal which has a concave, cylindrical sealing surface. U.S. Pat. No. 3,202,360 also discloses an airless spray tip having a rotatable turret member, which is sealed with a packing sleeve and nut.

A recently issued U.S. Pat. No. 4,165,836, discloses that plastic seals experience excessive wear and suggests that an entirely metal seal be used to provide metal-to-metal contact with the turret member. My experience with devices of this invention, however, reveals that a metal seal is not effective with low viscosity liquids, which leak from the assembly under the high pressures used in airless spraying.

In a typical spray application, it is frequently necessary to substitute differently sized orifice members, and this requires interchanging the turret member. Heretofore, the various seals and seal supports dislodged from the spray tips when the turret members were removed, complicating reassembly. It is desirable that the spray tip permit a simple removal and interchanging of the spray orifice without disassembly and without dislodgement of the other parts of the spray tip.

In may prior U.S. Pat. No. 4,484,707 I disclose that difficulties experienced in interchanging turret members can be avoided if the seal is indexed against rotation and retained against dislodgement when the turret member is removed. A similar construction is disclosed in U.S. Pat. No. 4,508,268.

All of the aforementioned patents disclose structures in which the compressive loading on the turret seal is achieved by tightening of the retainer nut which secures the spray tip to the barrel of the spray gun. A wide variety of materials have been suggested for the turret seal, with varying results. U.S. Pat. No. 4,165,836 suggests use of a metal seal. U.S. Pat. No. 4,508,268 suggests the use of hard steel, tungsten carbide, or ceramics. Seals formed of these very hard materials, however, do not seal adequately with low viscosity liquids or with very high liquid pressures.

In my prior U.S. Pat. No. 4,483,481, I have disclosed that the turret member can be sealed effectively against low viscosity liquids without seizure by using a very thin plastic seal on a metal seal support. While a very thin plastic seal such as disclosed in my parent application provides significant improvement over previous seals in that it permits use of the spray tip with low viscosity liquids without leaking and reduces the tendency of the turret member to seize, further improvement, particularly in longevity of the seal is desirable.

It is also desirable to provide a spray tip having a construction which is economical to manufacture and which provides the aforementioned sealing capability and longevity.

BRIEF STATEMENT OF THE INVENTION

This invention comprises a spray tip useful for high pressure, airless spraying which has an orifice tip holder that is reversible between spraying and cleaning positions and that is interchangeable with other holders supporting orifice tips of varied diameters and capacities. The orifice spray tip is mounted in a removable and rotatable turret member, and this turret member is sealed in the assembly by a floating piston seal in which the liquid line pressure provides the force to maintain the seal against the cylindrical member. The forward end of the floating piston seal has a seal face formed of a reinforced plastic. A very hard plastic such as an acetal copolymer is used and, preferably, this plastic is reinforced with glass fibers.

In further detail, the spray tip of the invention has a tubular housing with a longitudinal through passageway and an intersecting, orthogonal bore in which the cylindrical turret member is removably and rotatably mounted. The turret member has a transverse passageway in which is seated an orifice member formed of tungsten carbide. The floating piston is received in the longitudinal through passageway of the housing, and is sealed therein with an annular resilient seal, preferably with an elastic O-ring. A compression spring is preferably used to supplement the liquid line pressure in compressing the turret seal.

The housing is formed as a subassembly with a plastic spray guard having an internal cavity which receives the tubular housing. The spray guard has a slotted aperture to receive the turret member handle which has a radial prong that is received through the slotted aperture, thereby securing the assembly of the housing and turret member. The spray guard has internally molded shoulders which serve as rotational stops for the turret member handle, thus aligning the orifice tip with the through passageway of the housing in its spraying and cleaning positions. The spray tip is secured to the end of a spray gun with a retainer nut that engages a retaining flange carried by the housing adapter.

The spray tip of this invention provides very superior performance over all other spray tips. The seal is very effective, even with very low viscosity liquids and seals the turret member against leakage even at extremely high pressures which are sufficient to destroy the physical integrity of the seal. Even at very high liquid pressures, the turret member can be freely rotated between its spraying and cleaning positions. The annular resilient seal on the floating piston seal member permits the necessary axial movement of this member, while preventing dislodgement of the member when the turret members are removed or replaced.

The invention will be described with reference to the Figures, of which:

FIG. 2 is a sectional elevational view of the spray tip; and

FIG. 3 is a sectional elevational view of another embodiment of the floating seal in the spray tip.

DESCRIPTION OF THE PREFERRED EMBODIMENTS

Figure 1:
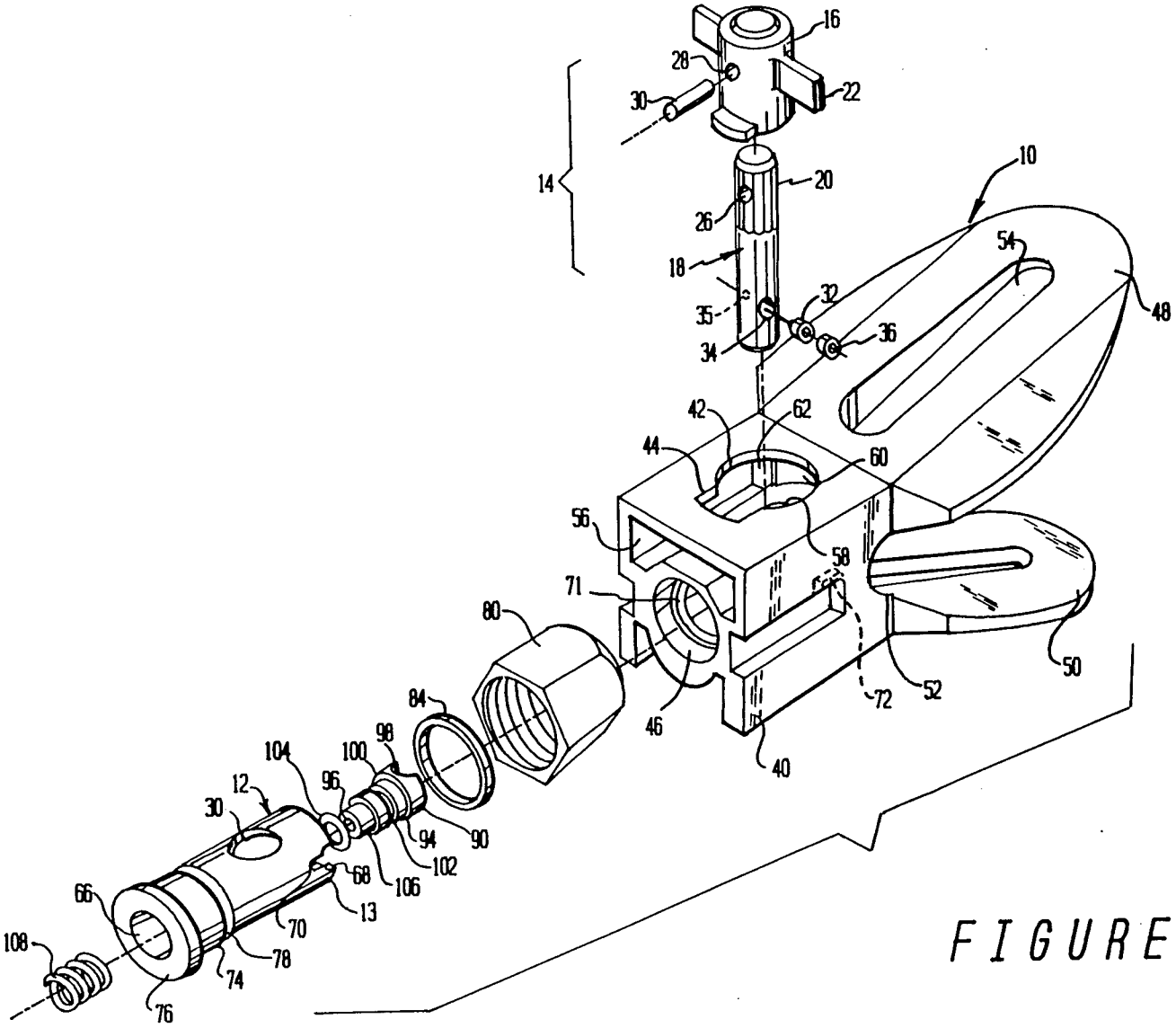
FIG. 1 is an exploded perspective view of the spray tip of the invention.

Referring now to FIG. 1, the invention is shown with a spray guard 10 which mounts on a tubular housing 12 that supports a turret member subassembly 14. The turret member subassembly 14 is formed of a handle 16 which is dependent from cylindrical turret member 18. The upper end 20 of turret member 18 preferably is splined, as illustrated, and is press-fitted into a central bore in the underside of handle 16. The handle 16 has a pair of ears 22, and a radial prong 24 at its base. The turret member is indexed to a precise position in handle 16 by alignment of transverse bore 26 in its upper end 20 with mating bore 28 in the handle, and a roll pin 30 can be used to complete the assembly.

The turret member 18 carries a spray tip orifice member 32 in a transverse bore 34. Bore 34 is counterbored with a small diameter through bore 35 which receives the forward end of the spray tip orifice member 32. The spray tip orifice member 32 is firmly seated against the annular shoulder between bore 34 and the counterbore 35. The counterbore should be of sufficient length that the orifice tip 32 does not project beyond the cylindrical surface of turret member 18. The orifice member 32 is retained in the assembly by sleeve 36 which is pressed into the bore 34.

The spray guard 10 has a body 40 with an aperture 42 to receive the base of handle 16. The turret member assembly 14 has a radial prong 24 and aperture 42 has a notch 44 which permits passage of the handle when the latter is rotated to align prong 24 with notch 44.

The spray guard 10 has a central longitudinal, cylindrical cavity 46 that receives the tubular body 13 of the housing 12. At its forward end, the spray guard 10 has a pair of outwardly diverging wings 48 and 50 which are generally trapezoidal. At the apex or intersection of wings 48 and 50, the spray guard has a slot 52 to provide clearance for the spray discharged from the spray tip. Each of the outwardly diverging wings 48 and 50 has a longitudinal, central, through slot such as 54. As illustrated for the preferred embodiment, the slots are narrow and extend substantially the entire length of wings 48 and 50.

The spray guard body 40 also has an internal cavity 56 superimposed over cavity 46 and this cavity has a central bore 58 to receive the turret member 18. The end interior wall 60 of cavity 56 has internal shoulders such as 62, which are spaced at opposite sides of the cavity 56. These shoulders serve as limiting stops for the rotation of the turret member, engaging prong 24 and permitting rotation of the turret member through only 180 degrees of rotation. These rotation-limiting stops are engaged when the turret member is in either its cleaning or spraying positions, with its transverse bore 34 in alignment with the longitudinal through passageway of the spray tip.

The tubular housing 12 has a longitudinal through passageway 66, and a cylindrical bore 30 orthogonal to and intersecting the longitudial through passageway 66 and this cylindrical bore 30 receives the cylindrical turret member 18. At its forward end, the housing 12 has an arcuate slot 68 at each side which has a smaller, longitudinal extension slot 70. The arcuate slot 68 aligns with the slot 52 in the spray guard body 40 and provides clearance for the liquid spray from the orifice 32. The extension slots 70 receive keys 72 on the internal sidewalls of the cavity 46 in the spray guard body 40, thereby keying the spray guard to the housing 12. At its upstream end 74, housing 12 has an annular flange 76, and an annular groove 78. The annular groove 78 receives a detenting rib 71 which is molded on the inside wall of the spray guard 12, thereby firmly securing the subassembly of housing 12 and spray guard 10.

The spray tip assembly is retained on the externally threaded barrel of a spray gun by the retainer cap nut 80 which is received over the housing 12. The annular end flange 76 is received within the retainer nut 80, and a low frictional characteristic, bearing washer 84 is captured between the annular flange 76 and the retainer nut 80. This washer provides very low frictional resistance between the retainer nut and the housing 12 when the retainer nut 80 is tightened. The central through passageway of the housing body 12 receives the floating piston seal 90.

The floating piston seal 90 comprises a sleeve body 94 with a through bore 96. At its forward end the sleeve body 94 carries turret seal 98. The seal 98 has a cylindrically concave face 100, to mate with the cylindrical contour of turret member 18. Sleeve body 94 has an annular groove 102 which receives an annular resilient sealing member, preferably an O-ring 104 to seal the floating piston in the longitudinal through passageway of housing 12. The upstream end of sleeve body 94 has a reduced diameter neck 106 and a compression spring 108 is received over this neck.

Referring now to FIG. 2, the spray tip is shown as assembled to a spray gun 110 by the retainer cap nut 80, which is tightened on to the threaded barrel 112 of the spray gun. The compression spring 108 bears against the end of the spray gun barrel and applies a resilient force to the piston seal 90. In FIG. 2, the forward end of the turret seal 98 is sectioned, to reveal the turret member 18, and this member is also sectioned, in part, to reveal the sleeve 36 and the orifice member 34.

FIG. 2 also illustrates an optional feature of the invention, which is seal washer 69 that is formed of a suitable low frictional characteristic plastic, e.g., Teflon, Nylon, etc. is retained between the end of the spray gun barrel and the inside face of flange 60 of adapter 58. In applications at low to moderate pressure, e.g., up to about 3000 psig., the combination of this washer and the low frictional characteristic washer 84 provide very low frictional drag resisting the turning of the spray tip when it is assembled onto the end of a spray gun, thereby permitting rotation of the spray pattern without loosening of the retainer nut 80 which secures the spray tip to the spray gun.

FIG. 3 illustrates a floating piston seal 91 having a sleeve body which is identical to that of seal 90 previously described. At its forward end, the sleeve body 94 carries turret seal 99, which has the same diameter as body 94.

The floating piston seal is an extremely effective dynamic seal for the turret member. The turret member is freely rotatable even at fluid pressures up to about 5000 psig., and the seal is effective even with very low viscosity liquids even at pressures which are sufficient to actually cause physical damage to the seal, e.g., pressures up to about 7500 pisg. The floating piston seal is compressed against the turret member by the line pressure which is applied against the upstream face of the piston, and the resultant force is sufficient to seal its cylindrically concave face against the turret member. The effectiveness of the piston seal is quite surprising in that the sealing face of the piston which is applied against the turret member has a greater surface area than the upstream face of the piston. The line pressure which is applied against the upstream face is nevertheless sufficient to force the piston sealing face against the turret member to prevent leaking of the fluid, even when there is no flow through the orifice tip, e.g., when the orifice tip becomes clogged. The spring 108 is preferably used in the assembly as it provides an initial seating of the piston seal face against the turret member. Without the spring, a slight leaking or spurting of liquid from the spray tip occurs when the line pressure is first applied, until the line pressure is effective to move the floating piston seal securely against the turret member. The use of the spring 108 avoids even this slight leaking.

The floating piston seal is formed entirely of plastic, which is filled with from 5 to 50, preferably from 15 to about 30, weight percent of a reinforcement filler. Various plastics can be used for this purpose, including acetal homopolymer and copolymer, polysulfones, polyphenylene sulfide, polycarbonate, thermosetting and thermoplastic polyimides, Nylon, poly(amide-imide), etc. Acetal copolymer is preferred for its hardness and wear resistance. The acetal copolymer is prepared by the copolymerization of trioane with slight amounts of a comonomer which provides carbon to carbon bonding in the polymer chain, thereby imparting a high degree of thermal stability to the polymer. The polymer has a very high creep resistance and a tensile strength in excess of 15,000 psi.

The fillers which can be used for reinforcement of the plastic seal body include graphite, silica, alumina powders, and fibrous reinforcements such as graphite and glass fibers. Preferably, glass fibers having lengths from about 0.05 to about 0.25 inch are used.

The spray tip of this invention is provided with a plurality of interchangeable turret members with varied sizes of orifice tips to permit the user to switch turret member whenever it is desired to change the volume or spread of the fan spray. The orifice tips can be provided in sizes from about 0.005 to about 0.075 inch in any varied increments, preferably in increments from about 0.001 to 0.003 inch. These orifice tips will provide a fan spray with a width from 2 to about 22 inches in approximately 2 inch increments.

The resilient annular seal means about the floating piston seal prevents any leakage of fluid past the piston and through the housing 12. It also restrains the piston seal 90 in the housing 12 against dislodgement or rotation when the turret member 18 is removed or replaced, thereby insuring that the turret member, or a replacement turret member, can be quickly inserted without need to reposition the seal support.

The invention provides a number of definite advantages over prior spray tips. The plastic seal of the invention tightly seals and prevents leakage even with low viscosity liquids. The turret member can be quickly reversed to its clean-out position, any obstructions can be sprayed out of the orifice, and the turret member can be returned to its spraying position, all without loosening the retainer nut. The turret member is easily removable from the spray tip simply by loosening retainer cap nut 80 and rotating the turret member handle 16 to align its prong 24 with the notch 44 of the spray guard. When the turret member is removed, the floating piston seal remains in place to permit rapid replacement of the turret member. With many applications (at low to moderate pressures), when the combination of the sealing and low frictional characteristic washers is used, the retainer cap nut can be tightened and loosened by hand and the spray tip can be rotated on the spray gun without loosening the cap nut. At higher pressures, the cap nut can be tightened with a wrench, with or without the low frictional washer 69 and complete sealing is achieved even up to pressures which are sufficient to destroy the internal seals of the tip, and throughout this pressure range, the turret is freely moveable bewteen its spraying and cleaning positions.

The invention has been described with reference to the illustrated and presently preferred embodiment. It is not intended that the invention be unduly limited by this disclosure of the presently preferred embodiment. Instead, it is intended that the invention be defined by the means, and their obvious equivalents, set forth in the following claims.

I claim:

1. A spray tip to receive liquid under line pressure from a source and to discharge a liquid spray which comprises:

(a) a housing having a longitudinal through passageway and an orthogonal bore adjacent one end of said housing and intersecting said through passageway;

(b) assembly means on the end of said housing opposite said one end to secure said housing to said source and apply said line pressure to said through passageway;

(c) a cylindrical turret member rotatably seated in said orthogonal bore and having a transverse bore in alignment with said through passageway, said turret member including means for axially releasably and rotatably retaining said turret member within said orthogonal bore.

(d) a spray tip orifice member mounted in said transverse bore;

(e) a single floating seal member axially slidably received in the end of said housing opposite said one end and in said through passageway thereof, and having a through bore, a forward, cylindrically concave seal face bearing against said turret member and serving as the only seal on said turret member, and an upstream face directly exposed to said line pressure; and (f) resilient annular seal means about said floating seal member and engaging the inside walls of said through passageway to effect fluid sealing of said floating seal member against said line pressure within said passageway, and to restrain said floating seal member against rotation within said through passageway when the fluid pressure is released and when said turret member is removed and replaced.

2. The spray tip member of claim 1 wherein said resilient annular seal means is an O-ring and including an annular groove about said floating seal member to receive said O-ring.

3. The spray tip member of claim 1 wherein said forward cylindrically concave sealing face has an area greater than the area of said upstream face of said floating seal member.

4. The spray tip member of claim 1 wherein said forward cylindrically concave sealing face has the same diameter as said upstream face of said floating seal member.

5. The spray tip member of claim 1 wherein said forward cylindrically concave sealing face is formed of a hard, reinforced plastic.

6. The spray tip of claim 1 wherein said plastic is filled with from 5 to 45 weight percent reinforcement material.

7. The spray tip of claim 1 wherein said reinforcement material is fiber glass and is present in an amount from 10 to about 30 weight percent.

8. The spray tip of claim 1 wherein said plastic is an acetal copolymer.

9. The spray tip of claim 1 including a compression spring captured between the upstream face of said floating seal member and the end of said spray gun to provide a resilient bias urging said forward cylindrically concave face to seat against said turret member.

10. The spray tip of claim 9 wherein said upstream face of said floating seal member has a reduced diameter shank received within said spring, to serve as a spring retainer.

11. The spray tip of claim 1 wherein said assembly means includes an annular outer flange at the upstream end of said housing and a retainer cap nut having a through bore with an annular end lip and received over said housing with a low friction bearing washer captured between the annular flanges of said cap nut and said annular end lip.

12. The spray tip of claim 11 including a second, low friction, bearing washer to be received within said retainer cap nut and bearing against said annular flange.

13. A spray tip comprising:

(a) a housing subassembly of:

(i) a housing having a longitudinal through passageway and an intersecting cylindrical orthogonal bore; and (ii) a plastic spray guard having a pair of outwardly diverging winds dependent from a spray guard body having a longitudinal through cavity received over said housing, a through transverse bore in said spray guard body aligned with said orthogonal bore of said housing;

(b) a cylindrical turret member having a transverse through bore, and rotatably seated in the aligned orthogonal and transverse bores of said housing and spray guard body;

(c) a handle member permanently secured to said turret member with a lip member radially projecting therefrom; and (d) a lip receiving cavity in the upper portion of said spray guard body having a slotted aperture opening thereto in alignment with said transverse bore to receive said lip member with one interior wall of said lip receiving cavity having internal shoulders at 180 degree spacing for abutment stops when the transverse through bore of said turret member is in alignment with said through passageway of said housing.

14. The spray tip of claim 13 including at least one slot in said housing and a coacting key on said spray guard to align said spray guard to said housing.

* * * * *

UNITED STATES PATENT AND TRADEMARK OFFICE

CERTIFICATE OF CORRECTION

PATENT NO. : 4,715,537

DATED : December 29, 1987

INVENTOR(S) : Oliver J. Calder

It is certified that error appears in the above—identified patent and that said Letters Patent is hereby corrected as shown below:

In the claims:

Column 8, line 12, change "winds" to --wings--

Signed and Sealed this

Tenth Day of May, 1988

*Attest:*

*Attesting Officer*

DONALD J. QUIGG

*Commissioner of Patents and Trademarks*